US006006509A

United States Patent [19]

Ballhausen et al.

[11] Patent Number: 6,006,509

[45] Date of Patent: Dec. 28, 1999

[54] METHOD FOR CONTINUOSLY PRODUCING A TWISTED YARD WITH MINIMAL CURLING TENDENCY

[75] Inventors: Ulrich Ballhausen, Krefeld; Wilfried Rütten, Wegberg; Markus Beckmann, Krefeld; Guido Spix, Kaarst; Stefan Kross, Viersen, all of Germany

[73] Assignee: Volkmann GmbH & Co., Germany

[21] Appl. No.: 09/106,037

[22] Filed: Jun. 26, 1998

[30] Foreign Application Priority Data

Jun. 26, 1997 [DE] Germany ..... 197 27 1760

[51] Int. Cl.[6] ..... D01H 4/00

[52] U.S. Cl. ..... 57/400; 57/75; 57/328; 57/404

[58] Field of Search ..... 57/75, 62, 400, 57/404, 328

[56] References Cited

U.S. PATENT DOCUMENTS

| | | | |
|---|---|---|---|
| 5,479,771 | 1/1996 | Ballhausen et al. | 57/406 |
| 5,499,496 | 3/1996 | Stenmans | 57/406 |
| 5,605,037 | 2/1997 | Ballhausen et al. | 57/406 |
| 5,628,177 | 5/1997 | Ballhausen et al. | 57/406 |
| 5,632,140 | 5/1997 | Ballhausen et al. | 57/409 |

FOREIGN PATENT DOCUMENTS

| | | | |
|---|---|---|---|
| 1552320 | 11/1968 | France . | |
| 1292555 | 3/1966 | Germany . | |
| 78710 | 12/1970 | Germany . | |
| 4004049 | 8/1991 | Germany . | |
| 4428780 | 8/1994 | Germany . | |
| 4430917 | 9/1995 | Germany . | |
| 4431830 | 10/1995 | Germany . | |
| 2 164 669 | 3/1986 | United Kingdom | 57/400 |

*Primary Examiner*—William Stryjewski
*Attorney, Agent, or Firm*—Robert W. Becker & Associates

[57] ABSTRACT

A method for continuously producing a twisted yarn with minimal curling tendency includes the steps of spinning a yarn and directly thereafter, within a time period of less than one second, twisting the yarn. The yarn tension at the end of the spinning step can be adjusted to be essentially the same as the yarn tension at the end of the twisting step, or, in the alternative, the yarn tension at the end of the twisting step is greater than 70% of the yarn tension at the end of the spinning step.

6 Claims, 2 Drawing Sheets

METHOD FOR CONTINUOSLY PRODUCING A TWISTED YARD WITH MINIMAL CURLING TENDENCY

BACKGROUND OF THE INVENTION

The present invention relates to a method for continuously manufacturing a yarn with minimal curling tendency.

Staple fiber yarns are produced of individual fibers of a certain staple fiber length which are arranged in parallel and are bundled. These fibers are usually natural fibers, for example, wool or cotton. However, they can also be produced of synthetic fibers. For this purpose, endless filaments are cut to the required staple fiber length of natural fibers.

In order to produce a mechanically strong yarn from a bundle of staple fibers, a certain twist must be imparted to the fiber bundles that have been stretched to the desired degree of fineness. This is carried out in the spinning process which increases the fiber-to-fiber friction.

The result is a yarn with greatly improved dynamo metric properties. The greater the twist applied to the yarn under consideration of the breaking tenacity, the greater the strength of the produced yarn.

The fiber bundle, but also the individual fibers within the bundle, receives the imprinted twist (torque) only against the resistance of the inner forces of the individual fibers. Only after a certain time has passed with simultaneous release of the yarn tension, a so-called relaxation in the twisted fiber strand occurs, i.e., an equilibrium state of the inner fiber forces results, i.e., the shaping imparted by the spinning process is "frozen" or set.

When a freshly spun yarn, after completion of the spinning process, is released, i.e., is allowed to freely assume its desired orientation, the fiber bundle and the embedded individual fibers follow the so-called memory effect and will turn in the opposite direction. This results in a curled yarn. This behavior of the twisted fiber strand or fiber bundle can only be counteracted by a ripening process, i.e., a fiber-specific time period for relaxation, or by artificial fixation, for example, by a moisture/heat treatment.

For producing a twisted yarn of staple fibers, at least two spun fibers or yarns are required which are twisted about their common axis, preferably counter to the rotational direction of the spinning process. The fiber strands (spun yarns) twisted in the previous spinning process and the individual fibers within the spun yarn are subjected to a return twist which, in certain situations, can be of such magnitude that the twist generated during the spinning process is cancelled.

Due to the spinning process, the spun yarns have a shape memory that counteracts during the twisting process the imprint of the twist. Accordingly, in the twisted yarn an uneven distribution between the forces imparted by the twisting process and the forces of the return twist of the spun fibers and the individual fibers may result. This produces a twisted yarn that has a great tendency to curl whereby the magnitude of the curl tendency is a direct function of the twist of the spun yarns imparted during the spinning process, on the one hand, and the degree of twist of the twisted yarn, on the other hand.

This curling tendency of the twisted yarn can only be counteracted, as in the spun yarns, by a ripening process or artificial fixation, i.e., a moisture/heat treatment.

A multitude of different combined or integrated spinning and twisting processes have been suggested in the prior art in which directly after the spinning process the twisting process is performed.

From printed documents FR 15 52 320 and DD 78 710, dating from 1969, respectively, 1970, as well as German patent 44 31 830 and German patent 44 30 917 methods and devices are known in which with two open end spinning devices, arranged above or adjacent to one another, individual spun yarns are produced which after the spinning process are combined and subjected to a twisting process.

While the printed document DD 78 710 discloses a combined spinning and twisting process only in general terms without providing a constructive solution, German patent 44 30 917 provides a constructive solution for performing an integrated spinning and twisting process. Here, the loose individual fibers are guided into at least two open end spinning devices, positioned on a common rotor and arranged within a double twisting spindle, such that the spun yarns produced in the open end spinning devices are directly after completion of spinning twisted in the double twisting process to form a twisted yarn.

According to French printed document 15 52 320 a down twisting device (cap yarn twister) is arranged downstream of at least two stationary open end spinning rotors supported on a common machine frame. It is questionable whether, due to the different machining speeds of the open end spinning rotors, on the one hand, and the ring twisting device on the other hand this method is feasible.

According to German patent 44 30 917 the loose individual fibers are guided through the rotor axis of two open end spinning devices supported in a common rotor and the spun yarns exiting from the spinning devices are directly subjected to a single twisting process.

In order to provide a combined and continuous spinning, spooling, and twisting method, it is known to place onto a hollow spindle a yarn bobbin that has been produced in a conventional ring spindle. A roving coming, for example, from a creel, passes through a conventional stretching device and is then introduced together with the spun yarn of the yarn bobbin, placed onto the hollow spindle, into the hollow spindle axle. The yarn of the bobbin is then removed by the spindle rotation and enters together with the stretched roving through the hollow spindle to a winding device, as disclosed, for example in, "eine neue Spinn-Zwirnmachine" published in "Melliand-Textilberichte", December 1966, pages 1354 and 1355.

In a method disclosed in German patent 44 28 780 a twisted yarn is produced in a first method step by removing two rovings from two roving supplies and guiding them through a stretching device. Thereafter, they are independently spun by a ring spinning process and then wound onto two bobbins permanently placed onto hollow spindles arranged on top of one another in order to produce to spun yarn bobbins. In a second process step, the spun yarns wound onto the spun yarn bobbins are then removed by forming a yarn balloon from the bobbins and guided through the hollow axles of the respective hollow spindles, while at the same time guiding the yarn of the upper hollow spindle also through the lower hollow spindle axle, and toward a winding device positioned below the lower hollow spindle. The hollow spindles are rotated as a function of the removal speed of the winding device such that the twist of the two spun yarns is partially cancelled.

In the two latter systems, ring spinning spindles are used whose yarns are subsequently guided to the twisting device.

It is an object of the present invention to provide a method for producing a twisted yarn with reduced curling tendency and reduced twisting moment (torque) which can be directly processed further without requiring ripening times or additional fixation methods as discussed above.

SUMMARY OF THE INVENTION

Torque-reduced twisted yarns with reduced curling tendency are required for most further yarn processing purposes and applications in order to reduce the known damaging effects of so-called wild yarns or twisted yarns.

According to the present invention, the inventive method includes the steps of spinning a yarn and directly thereafter, within a time period of less than one second, twisting the yarn whereby the yarn tension at the end of the spinning step is preferably essentially the same as the yarn tension at the end of the twisting step, or, in the alternative, the yarn tension at the end of the twisting step is greater than 70% of the yarn tension at the end of the spinning step.

Essentially three parameters or factors are important in regard to the present invention.

Firstly, a short residence time of the spun yarn, respectively, spun yarns in the spinning zone is important, i.e., the time factor is important.

Secondly, a certain yarn pulling force, respectively, yarn tension, to which the spun yarns and the twisted yarn formed directly thereafter are subjected, must be maintained until final winding onto the yarn bobbin.

Thirdly, by not winding the spun yarns in intermediate processing steps and thus eliminating the possibility of release of tension of the spun yarn strand, no memory effect within the spun yarns will occur which during the twisting process would counteract the twist to be imparted.

The inventive method can be performed such that the initially performed spinning process, depending on of the subsequently performed twisting process, is an open end spinning process or an air spinning process.

According to the present invention, the spinning process and the twisting process are performed without interruption in a continuous method with substantially constant yarn pulling force (yarn tension) and very short travel distance, respectively, very short time periods between completion of the spinning process and beginning of the twisting process, respectively, completion of the twisting process. Thus, after imparting the spinning twist by producing the simple spun yarns, there is only a minimal amount of time for the spun fiber bundle to follow its tendency to return into the parallel orientation or for the generation of a shape memory with respect to the spinning direction of the spun yarn. By maintaining the yarn pulling force, respectively, yarn tension constant, "freezing" of the twisted fiber bundle and individual fibers is also counteracted.

The yarn pulling forces depend on the staple fiber material to be spun and twisted, the embodiment of the employed device, and the respective method parameters.

The pulling force (yarn tension) values can be preferably adjusted by feed devices between the spinning zone and the twisting zone.

As a result of the short time frame in which the two process steps are performed and of the constant yarn tension, the single spun yarns thus provide only very minimal resistance forces to the subsequent twisting process and a spun yarn/twisted yarn product results having an inner return moment that is only minimal. Since the return moment in the yarn body is thus minimalized due to the aforementioned interacting effects, the compensation state caused by relaxation of the twisted yarn on the bobbin will occur already after a very short period of time. In this manner, the memory effect in the elastic twisted medium and in the elastic spun medium is substantially entirely avoided, and is thus also not transferred onto the twisted state so that the curling tendency is substantially eliminated. Preferably, the time period between completion of the spinning process and completion of the twisting process is reduced to a value of less than 0.5 seconds, especially less than 0.1 seconds.

As a function of the twisted yarn to be produced the following spinning and twisting feeding speeds are selected.

| Nm | tex | feeding speed in m/min. |
|---|---|---|
| 20/2 | 50 × 2 | 100–200 |
| 50/2 | 20 × 2 | 60–170 |
| 70/2 | 14 × 2 | 40–140 |

BRIEF DESCRIPTION OF THE DRAWINGS

The object and advantages of the present invention will appear more clearly from the following specification in conjunction with the accompanying drawings in which.

DESCRIPTION OF PREFERRED EMBODIMENTS

The present invention will now be described in detail with the aid of several specific embodiments utilizing FIGS. 1 and 2.

Figure 1:
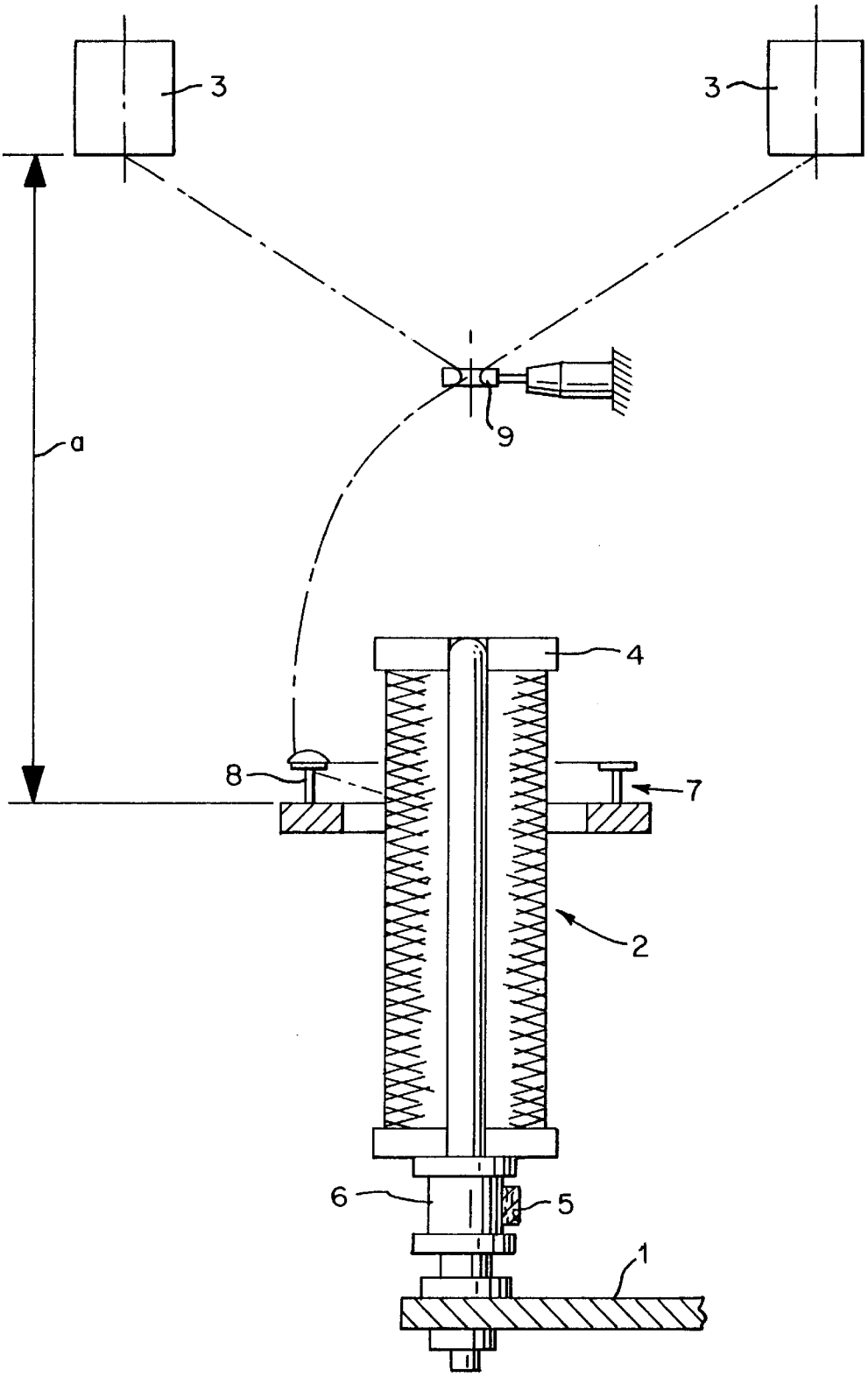
FIG. 1 shows schematically, partially in section, a combined spinning and twisting device.

The device represented in FIG. 1 comprises a conventional down twisting spindle 2 supported on a machine frame 1 having positioned upstream thereof spinning devices 3, 3 represented only schematically. These spinning devices may be conventional air spinning devices, as disclosed in German published document 40 04 049, disclosing a roving being stretched to the desired yarn fineness and guided into an air nozzle. The air nozzle has a tubular yarn channel into which at least one blower nozzle opens tangentially in order to produce within the yarn channel a turbulent flow that effects the spinning process in the predetermined rotational direction.

The down twisting spindle 2 comprises a spindle whorl 6 driven by a tangential drive belt 5 for rotating the twisting spindle 4 as well as a reciprocating ring 7 with coordinated traveler 8.

The distance "a" represents the travel path and thus the time factor, deduced therefrom by taking into consideration the yarn feeding speed between the spinning devices 3 and the twisting zone represented by the ring slide 8. Between the spinning zone and the twisting zone a conventional yarn guide 9 is positioned.

Figure 2:
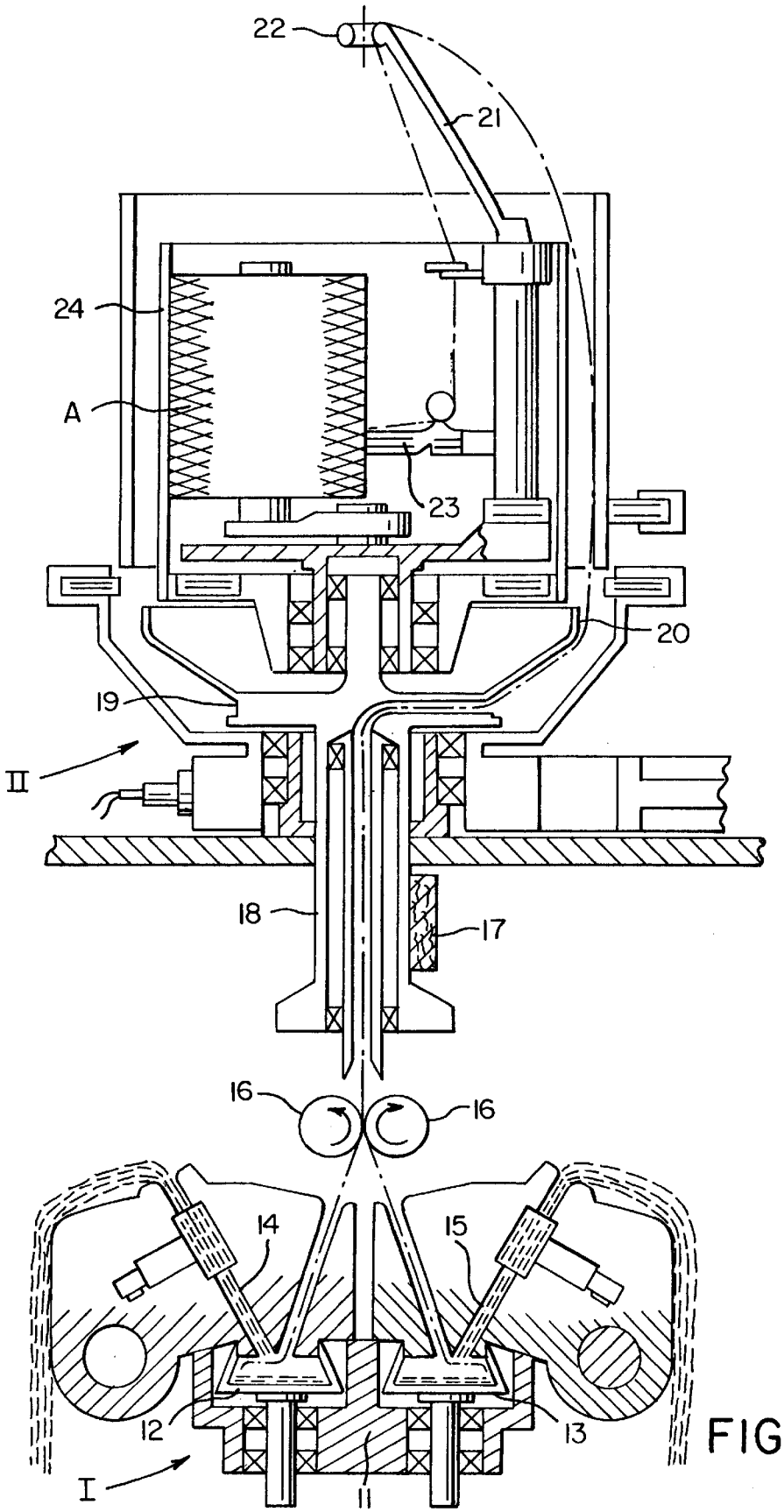
FIG. 2 shows schematically, partially in section, an integrated spinning and twisting device, whereby both devices are designed for performing the inventive method.

The device represented in FIG. 2 comprises a spinning device I with at least two adjacently positioned open end spinning rotors 12, 13 supported on machine frame 11. Feed channels 14, 15 for supplying the fiber material open into the rotors 12, 13 in a manner known per se.

A two-for-one twisting device II is coordinated with a spinning portion I. The two-for-one twisting spindle comprises a winding bobbin A arranged in its interior. Such a two-for-one twisting spindle is, for example, known from German patent 12 92 555 (U.S. Pat. No. 3,368,336). The disclosure of these documents is incorporated by reference in order to provide the needed disclosure for the individual constructive elements. As an essential component such a two-for-one twisting spindle comprises a hollow whorl 18 that is driven by a tangential drive belt 17, whereby the whorl 18, the yarn storage disc 19, and the overflow plate 20 form the spindle rotor.

The spun yarns removed by the roller pair 16, 16 from the open end spinning rotors 12, 13 are introduced from below axially through the hollow whorl 18 and are guided radially outwardly through the yarn storage disc 19. They move from the edge of the overflow plate 20 in the form of a balloon in the upward direction whereby the tip of the balloon is determined by a yarn guide 22 positioned on an imaginary extension of the spindle axle. The yarn guide 22 is connected to a projecting arm 21 positioned at a slant relative to the spindle axle. The two spun yarns are guided via suitable guide elements into a reciprocating guide 23 moving in the vertical direction in order to be wound onto the winding bobbin A which is rotated by the protective pot contacting its outer mantle surface. Such a protective pot 24 is rotated in a manner conventional for two-for-one twisting spindle.

The specification incorporates by reference the disclosure of German priority document 197 27 176.6 of Jun. 26, 1997.

The present invention is, of course, in no way restricted to the specific disclosure of the specification and drawings, but also encompasses any modifications within the scope of the appended claims.

What is claimed is:

1. A method for continuously producing a twisted yarn with minimal curling tendency, said method comprising the steps of:

spinning yarns in spinning devices and, directly after leaving the spinning devices within a time period of less than 1 sec., twisting the yarns in a twisting device to a twisted yarn; and adjusting a yarn tension of the yarns leaving the spinning devices to be essentially the same as a yarn tension of the twisted yarn leaving the twisting device by selecting the feeding speed of the yarns from the spinning devices to the twisting device depending on the desired characteristics of the twisted yarn as follows:

| Nm | tex | feeding speed in m/min. |
|---|---|---|
| 20/2 | 50 × 2 | 100–200 |
| 50/2 | 20 × 2 | 60–170 |
| 70/2 | 14 × 2 | 40–140 |

2. A method according to claim 1, wherein the time period is less than 0.5 sec.

3. A method according to claim 2, wherein the time period is less than 0.1 sec.

4. A method for continuously producing a twisted yarn with minimal curling tendency, said method comprising the steps of:

spinning yarns in spinning devices and, directly after leaving the spinning devices within a time period of less than 1 sec., twisting the yarns in a twisting device to a twisted yarn; and adjusting a yarn tension of the yarns leaving the twisting device to be greater than 70% of a yarn tension of the yarns leaving the spinning devices by selecting the feeding speed of the yarns from the spinning step to the twisting step depending on the desired characteristics of the twisted yarn as follows:

| Nm | tex | feeding speed in m/min. |
|---|---|---|
| 20/2 | 50 × 2 | 100–200 |
| 50/2 | 20 × 2 | 60–170 |
| 70/2 | 14 × 2 | 40—140 |

5. A method according to claim 4, wherein the time period is less than 0.5 sec.

6. A method according to claim 5, wherein the time period is less than 0.1 sec.

* * * * *

UNITED STATES PATENT AND TRADEMARK OFFICE

CERTIFICATE OF CORRECTION

PATENT NO. : 6,006,509

DATED : 12/28/99

INVENTOR(S) : Ulrich Ballhausen et al

It is certified that error appears in the above-identified patent and that said Letters Patent is hereby corrected as shown below:

Title page, Item [30] should read as follows:

[30] Foreign Application Priority Data

Jun. 26, 1997 [DE] Germany.....197 27 176.6-26

Signed and Sealed this

Eighth Day of August, 2000

*Attest:*

Q. TODD DICKINSON

*Attesting Officer*

*Director of Patents and Trademarks*